US008330395B2

(12) United States Patent
Hoschopf

(10) Patent No.: US 8,330,395 B2
(45) Date of Patent: Dec. 11, 2012

(54) LED LIGHTING SYSTEM WITH OPTICAL COMMUNICATION FUNCTIONALITY

(75) Inventor: Hans Hoschopf, Jennersdorf (AT)

(73) Assignee: Ledon Lighting Jennersdorf GmbH, Jennersdorf (AT)

( * ) Notice: Subject to any disclaimer, the term of this patent is extended or adjusted under 35 U.S.C. 154(b) by 188 days.

(21) Appl. No.: 12/865,678

(22) PCT Filed: Jan. 28, 2009

(86) PCT No.: PCT/EP2009/000541
§ 371 (c)(1),
(2), (4) Date: Jul. 30, 2010

(87) PCT Pub. No.: WO2009/095222
PCT Pub. Date: Aug. 6, 2009

(65) Prior Publication Data

US 2010/0327780 A1 Dec. 30, 2010

(30) Foreign Application Priority Data

Jan. 31, 2008 (EP) ..... 08101151

(51) Int. Cl.
*H05B 37/00* (2006.01)

(52) U.S. Cl. ..... 315/312; 315/307; 315/361

(58) Field of Classification Search ..... 315/291, 315/292, 295, 297, 307, 312, 316–319, 323, 315/361–362
See application file for complete search history.

(56) References Cited

U.S. PATENT DOCUMENTS

| | | | | |
|---|---|---|---|---|
| 6,548,967 | B1 | 4/2003 | Dowling | |
| 7,309,965 | B2 * | 12/2007 | Dowling et al. | 315/318 |
| 7,560,677 | B2 * | 7/2009 | Lyons et al. | 250/205 |
| 7,616,896 | B2 * | 11/2009 | Houck et al. | 398/115 |
| 2003/0057887 | A1 | 3/2003 | Dowling | |
| 2004/0160199 | A1 | 8/2004 | Morgan | |
| 2008/0253766 | A1 * | 10/2008 | Yu et al. | 398/41 |

FOREIGN PATENT DOCUMENTS

WO 02/098182 A2 12/2002

OTHER PUBLICATIONS

International Preliminary Report on Patentability mailed May 26, 2010, issued in corresponding International Application No. PCT/EP2009/000541, filed Jan. 28, 2009.
International Search Report mailed Apr. 17, 2009, issued in corresponding International Application No. PCT/EP2009/000541, filed Jan. 28, 2009.

* cited by examiner

*Primary Examiner* — James H Cho
(74) *Attorney, Agent, or Firm* — Christensen O'Connor Johnson Kindness PLLC

(57) ABSTRACT

A lighting system (20) comprises a plurality of light units (1, 6, 10, 11), each light unit (1, 6, 10, 11) including a photo sensor (2, 7), a light source (4, 9) and a control unit (3, 8) adapted to operate the light source (4, 9) and to modulate the light emitted by the light source (4, 9) so as to transmit data, wherein the light units (1, 6, 10, 11) are arranged according to a ring topology.

17 Claims, 2 Drawing Sheets

LED LIGHTING SYSTEM WITH OPTICAL COMMUNICATION FUNCTIONALITY

The present invention relates generally to a lighting system that can be controlled and operated by a dedicated controlling unit. More specifically, the present invention relates to lighting systems for which a lighting parameter of a lighting source can be set via the dedicated controlling device e.g. by an external third party device.

It is well known in the art to control the lighting parameters of a complex lighting system like the dimming by using digital protocols like for example the established DALI (Digital Addressable Lighting Interface), DMX (Digital Multiplex) or DSI (Digital Signal Interface) protocols.

DMX is a communication protocol that is commonly used to control stage lighting and effects. In order to control the lighting parameters of different lighting units, a given central controller is connected through a DMX communication bus to all units that should be controlled.

The DALI protocol, as well as the DSI protocol, is commonly used for the controlling of lighting in buildings. This digital communication protocol is particularly suitable for large-scaled networks comprising a plurality of distributed lighting resources within for example a building or a part of a building.

A DALI network is controlled centrally by a DALI controller connected to each light of the network via a wired bus. In this regard the central controller is not connected directly to the lights but rather via respective DALI devices that are able to communication with the DALI controller and to operate the respective light in accordance with the instructions of the central DALI controller.

The instructions of the central controller for operating the lights are transmitted to the distributed DALI devices over the bi-directional wired bus, such that the central DALI controller can set the status of each light and also query said status.

If such digital protocols are well suited for large-scaled networks, it is a fact that they are not very adapted to small networks comprising for example only a few light sources because it requires the installation of a wired bus for the communication between the central controller and the units. Another disadvantage of such a centrally controlled system is that prior to sending instructions each lighting unit should be assigned a unique address on the bus, which may be confusing and time consuming.

The unpublished patent application DE 10 2006 046 489.3 of TridonicAtco GmbH & Co. KG proposes a first solution to those problems in that electronic ballasts for operating gas discharge lamps can communicate with each other without requiring any wired bus.

A first electronic ballast is thereby able to modulate the light emitted by the gas discharge lamps it is operating. This modulation allows for a communication of information from this first electronic ballast to a second electronic ballast, which receives the modulated signal by means of a photodetector. The second electronic ballast then has to demodulate the received signal to get the original information sent by the first ballast.

The information that can be transmitted from a ballast to the other one relate to the intensity or the frequency of the light emitted by the first gas discharge lamp.

However this communication system is limited to gas discharge lamps and their electronic ballasts. Further on this communication system does not deal with the propagation of information within a small network of lighting units.

It is therefore an object of the present invention to solve the foregoing limitations and problems and to improve the control of light sources. An object of the invention is especially to improve the control of several light sources that can be put in optical communication.

Generally this object is achieved by "driving light by light", i.e. a control of a light source is achieved by transmitting parameters via light, which can also be used for illumination purposes. The transmission can be bidirectional, i.e. a propagation and a back-propagation channel between a "master" light source and a "slave" light source (controlled via the light of the master light source) can be provided.

According to the proposed solution, a first or master light source is controlled to a certain operation parameter or setting, which can relate e.g. to the intensity, spectrum, colour, etc. of the light source. This setting can then be propagated to at least one further light source by modulating the emitted light of the first light source such that the at least one further light source (also called slave light sources), being provided with a light sensor, can detect the setting of the first or master light source. The operation parameter(s) (i.e. intensity, colour, spectrum, etc.) of the slave light sources can than be adapted to that of the first or master light source.

Note that the at least one further light source can either directly detect the light characteristics of the first light source or demodulate digital or analogue information encoded in the light emitted from the first light source Thus, by controlling the master light source, it is possible to operate in a desired way the master light source as well as one or several slave light sources. A slave light source is thereby connected to the master light source either directly (i.e. in optical connection), in case its light sensor is able to receive light or signals emitted by the master light source, or indirectly, in case said light sensor can only receive the light or signals of the master source retransmitted via one or further slave light sources. In any case, at the end of the control cycle all light sources which are directly or indirectly optically connected to the master light source by their respective light sensor will assume the same behaviour.

The optical communication preferably is within the spectrum visible for the human eye. The modulation frequency preferably is higher than the resolution of the human vision.

According to an aspect of the present invention, an LED (i.e. light emitting diode) light source system is proposed, comprising a master light source and a slave light source. Each light source comprises at least one LED and a control unit for operating said LED. The slave light source is provided with a photo sensor arranged for detecting the light emitted from the master light source. The control unit of the slave light source is connected to the photo sensor and is designed to set operation parameters of the slave light source as a function of the light emitted from the master light source.

Thereby the slave light source can be provided with means for demodulating the light from the master light source in case the operation parameters are encoded by modulating the intensity, phase, color etc. of the light emitted by the master light source.

The LED light source comprises preferably a photo sensor designed to detect a modulated light signal. The control unit can include means for demodulating the modulated light signal detected by the photo sensor.

According to a further aspect of the present invention, an LED (i.e. light emitting diode) system for illumination and data transmission is proposed. Said LED system includes a first LED light source comprising at least one LED and a control unit for operating said LED, and a second LED light source comprising at least one LED, a control unit for operating said LED and a photo sensor. The control unit of the first LED light source is designed to transmit data wirelessly by modulating the light emitted by the LED.

The photo sensor can be designed to detect the light signal emitted by the LED of the first LED light source and the control unit can be designed to demodulate the light signal detected by the photo sensor so as to obtain the data transmitted wirelessly by said first LED light source.

The data can be transmitted using an analog modulation, a frequency or amplitude modulation, or a pulse modulation method.

According to a further aspect of the present invention a lighting system is proposed. It comprises a plurality of light units, each light unit including a photo sensor, a light source and a control unit adapted to operate the light source and to modulate the light emitted by the light source so as to transmit data. The light units are arranged according to a ring topology.

Each light unit can be wirelessly connected to at least a previous light unit and a next light unit, in that the light unit is able to receive via its photo sensor modulated data from said previous light unit, and to send via its light source modulated data to the next light unit.

The control unit of each light units can be designed to demodulate the modulated data or signal received from the previous light unit.

A light unit referred to as the master light unit can be adapted to transmit data by modulating the light emitted by its light source, said data being then transmitted automatically among the remaining light units referred to as slave light units in that each slave light unit receiving said data automatically forwards said data via its light unit to the next light unit of the ring.

The master light unit stores the data transmitted and waits for the reception of said data from the last slave light unit of the ring, which would indicate a successful propagation of the data over the whole ring.

Preferably, the master light unit retransmits the data if, after a given period of time, it has not received the data from the last slave light unit of the ring.

According to a further aspect of the present invention, a lighting system comprising a plurality of light units is proposed. Each light unit includes a photo sensor, a light source and a control unit adapted to operate the light source and to modulate the light emitted by the light source so as to transmit data. The data transmitted by a given light unit propagates over the remaining light units.

According to a further aspect of the present invention, it is proposed a communication method for a lighting system comprising a plurality of light units arranged according to a ring topology. Each light unit includes a photo sensor, a light source and a control unit adapted to operate the respective light source and to modulate the light emitted by the light source so as to transmit data. In a first step, one of the light units referred to as the master light unit transmits data wirelessly via its light source. In a next step, said data is transmitted automatically among the remaining light units of the ring, referred to as slave light units.

The foregoing form as well as other forms, features and advantages of the invention will become further apparent from the following detailed description of the embodiments, read in conjunction with the accompanying drawings. The detailed description and drawings are merely illustrative of the invention rather than limiting, the scope of the invention being defined by the appended claims.

FIG. 1 shows an LED (light emitting diode) system 12 according to an embodiment of the present invention.

Figure 1:
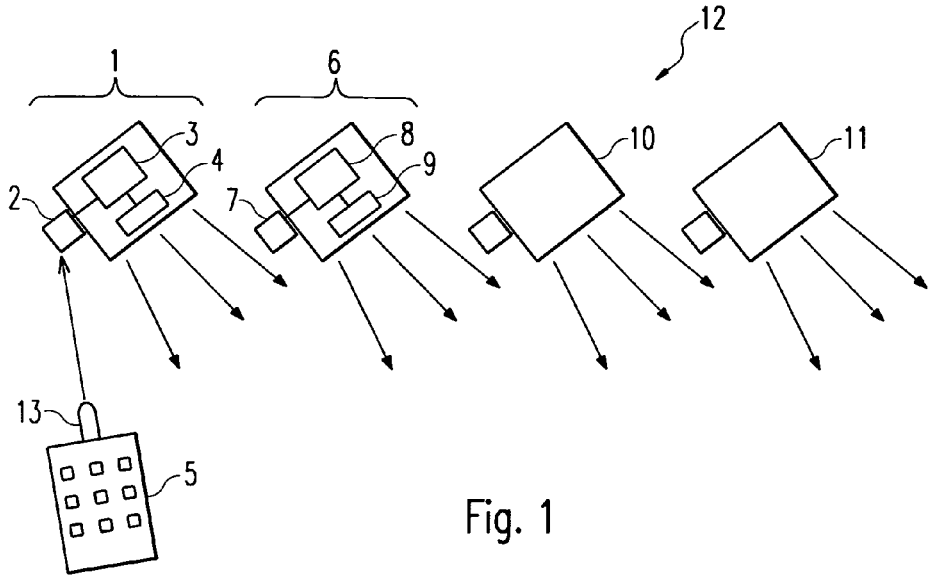
FIG. 1 illustrates a lighting system according to a first embodiment of the present invention.

The LED system 12 comprises a plurality of LED light sources 1, 6, 10, 11 each preferably comprising an LED or a set of LEDs 4, 9. The different LED light sources 1, 6, 10, 11 preferably comprise the same type and number of LEDs 4, 9 such that they can generate a similar light.

According to alternative embodiments the LED can be replaced by alternate light sources like one or more incandescent light bulbs, lasers, gas discharge lamps such as fluorescent lamps, etc.

Each LED light source 1, 6 further on comprises a control unit 3, 8 that controls and operates the respective LED 4, 9 by supplying it with a variable current. The control unit 3, 8 preferably consists in a microcontroller.

If the LED light source 1, 6 contains more than one LED, the control unit 3, 8 is able to operate the different LEDs independently. In particular it is possible for the control unit to control LEDs of different types or different colour. By operating adequately the different LEDs the LED light source 1, 6 may emit light having a varying colour, temperature or spectrum.

The control unit 3, 8 is therefore adapted to set or modify the parameters of the emitted light like for example the colour, the temperature, the intensity of the spectrum.

Each LED light source 1, 6 preferably comprises a photo sensor 2, 7 for sensing or detecting the light in the surroundings of the LED light source 1, 6.

The photo sensor 2, 7 is a device known in the art and can e.g. consist in a photo resistor or a photo diode.

The information collected or detected by the photo sensor 2, 7 is transmitted to the control unit 3 that can take account of that information to operate the light source (e.g. LED) 4, 9. The photo sensor 2, 7 may e.g. be utilized to detect the intensity of the associated LED 4, 9 in order to regulate the emitted intensity to a desired level.

This is an example in which the "slave" light source is designed to analyse the light emitted from a "master" light source in order to "copy" the characteristics (intensity, color etc.) of the master light source. This information can be directly obtained by analysing the light received by the photo sensor of the slave light source, and/or by encoding information by modulating e.g. the color or intensity of the master light source.

Each control unit 3, 8 thus can be designed to modulate the light emitted by the LED 4, 9 according to a known analog or digital modulation scheme so as to transmit data of any kind. This transmission is achieved optically, e.g. in the visual spectrum.

The present invention now proposes that a first LED light source 1 generates a modulated light signal carrying a useful signal and that a second LED light source 6 detects and demodulates said modulated light signal.

In operation, the first LED light source 1 can provide illumination and at the same time can transmit useful data.

The photo sensor 7 of the second LED light source 6 is oriented such that it is adapted to receive the light emitted by the first LED light source 1. In operation, the second LED light source 6 is therefore able to provide illumination by means of the LED 9 and to receive useful data via the photo sensor 7 and the demodulation capacities of the control unit 8.

A lighting system 12 of the invention is therefore also a communication system in form of a simple wireless bus system. The information or data can be transferred by means of a preferably very short and preferably invisible light modulation of the light source 4, 9.

According to an embodiment of the invention, each control unit 3, 8 is addressable within the lighting system 12. This means that the demodulated data contains useful data as well as an address corresponding to the recipient of the data. Only the control unit 3, 8 having an address corresponding to the address included in the sent data should consider the useful data accompanying the address. The other control units 3, 8 should ignore said useful data.

FIG. 1 shows a light pen or remote controller 5 including a preferably little light source 13 able to be modulated with different frequencies or bursts. Preferably, the light emitted by the light source 13 of the pen 5 can be modulated with a modulation corresponding to the modulation used within the LED light sources 1, 6, 10, 11.

The pen 5 can emit light of any colour. Preferably the pen 5 emits in the visible spectrum such that an operator using the pen 5 is able to control the direction of emission, i.e. where the pen 5 is pointing at.

According to the invention, the operator can cause a modification of the operation of the lighting system 12 by pointing the light emitted by the pen 5 at the photo sensor 2 of an LED light source 1, which will be called master light source, and by generating a modulated light signal carrying e.g. new parameters for the lighting system 12.

The control unit 3 of the master light source then demodulates the transmitted light signal and deduces the new parameters of the lighting system 12, e.g. the new colour, temperature, intensity, spectrum, etc.

The master light source thereupon operates its LED 4 according to the new parameters and in parallel transmits the new parameters as described above to the neighbouring LED light sources 6, 10, 11, called slave light sources. The slave light sources in turn preferably forward the new parameters to further slave light sources that are not able to receive the modulated light signal of the master light source.

In order to transmit the new parameters the master or slave light sources preferably change the intensity of the emitted light to short pulses or high frequencies so that a human eye will not be able to detect the modulation.

After having received one or several new parameters, the master and the slave lighting sources react accordingly e.g. by dimming the intensity if the new parameter modifies the intensity of the emitted light. If the new parameter defines a new colour and if the light source includes RGB LEDs, then the colour generated by the LEDs may be changed.

Figure 2:
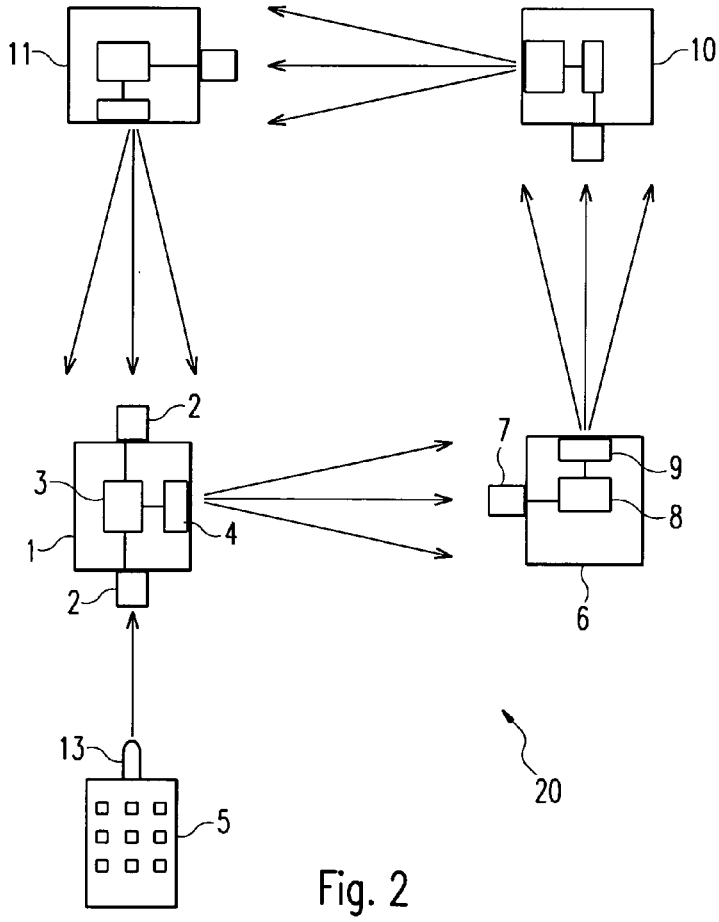
FIG. 2 illustrates alternative embodiment of the present invention.

While FIG. 1 illustrates how signals/data can be propagated from the master light source 1 to the different slave light sources 6, 10, 11, FIG. 2 illustrates a further aspect of the invention that is the back propagation of signals from the slave light sources 6, 10, 11 to the master light source 1.

The lighting system 20 shown in FIG. 2 has a ring topology. The lighting source that is controlled by the pen 5 is the master lighting source 1 that will detect as described above the new parameters to apply to the system 20. Said parameters are forwarded to the different slave lighting sources 6, 10, 11 and subsequently the last slave lighting source 11 in the ring transmits the parameters back to the master lighting source 1.

The ring topology ensures that each lighting source of the system 20 will receive the new parameters.

In alternative embodiments the information transmitted over the ring may also relate to the status of the LEDs 4, 9 within the system 20. A lighting source receiving information about the new parameters (intensity, colour, etc.) will correspondingly forward the received information together with additional information about the status of its own LED 4, 9. At the end of the ring, the master lighting source 1 thus obtains the status of each lighting source 1, 6, 10, 11 of the system 20.

In a system 20 using a ring topology it is also easy to check whether or not the new parameters have been applied over the whole system 20. The master lighting source 1 receiving a message containing new parameters from the last slave lighting source 11 can conclude that the whole system 20 has been updated with the new parameters.

Figure 3:
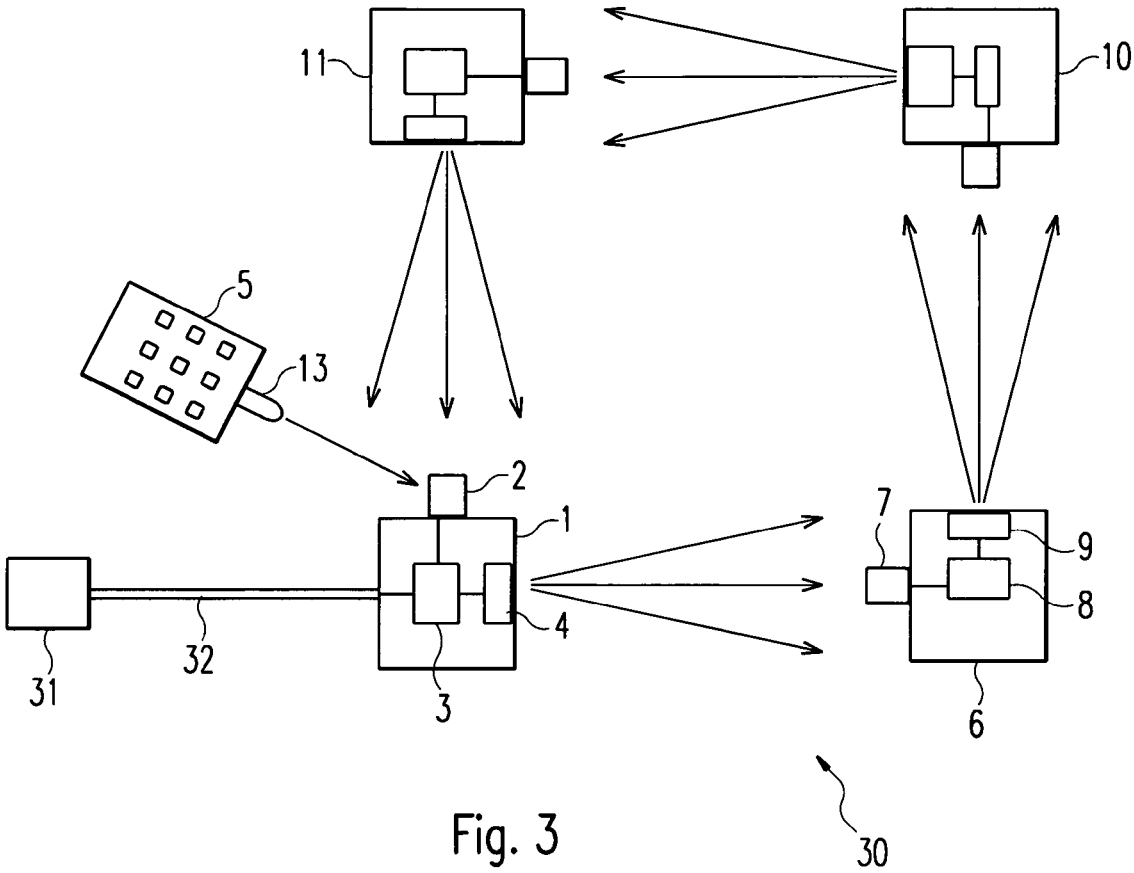
FIG. 3 illustrates a lighting system according to a first embodiment of the present invention.

FIG. 3 shows an alternative embodiment of the present invention based on a ring topology, wherein the master lighting source 1 is connected to a central controller 31 via a data bus 32, e.g. a DALI bus.

The master lighting source 1 can alternatively receive data or new parameters from the pen 5 or from the central controller 31. In addition thereto said master lighting source 1 can even transmit to the central controller 31 information e.g. about the status of the system 30 or about the status of the slave lighting sources.

Malfunctions of single light sources are detected by any of the photo sensors and can be visualized by flashing of all other light sources for a short period of time in constant recurrent sequences or, in the system 30 of FIG. 3, can be notified to the central controller 31.

If the topology of the lighting network is undefined, the LED light sources 1, 6, 10, 11 are preferably programmed to send received information or parameters over a frequency and/or amplitude modulation in such a way that the human eye cannot recognize the influence of the modulation on the illumination. A positive effect of the frequency and/or amplitude modulation is that the interfering influence of scattered or ambient light can be avoided.

The information or parameters are preferably sent by the lighting sources after a first or initial burst and before a second or final burst, wherein a burst can be characterised by a series of impulses or by a series of different intensities and/or frequencies. A neighbouring lighting source should thus receive the first and the second burst in order to validate the received information or parameters.

In case said neighbouring lighting source only receives the first or the second burst, it will switch in an error mode. The error mode can also be activated by a lighting source if its photo sensor detects a neighbouring illumination that does not correspond to its internal parameters.

A lighting source being in the error mode can send an error message e.g. in form of an error burst to the surrounding lighting sources that will as a response resend the new information or new parameters.

The invention claimed is:

1. A LED system, comprising:

at least a first LED light source and a second LED light source, each light source being provided with a control unit for operating a LED, at least the second LED light source being provided with a photo sensor, wherein the first LED light source is arranged to optically transmit data to the second LED light source, wherein the control unit of said second LED light source sets an operation parameter of said second LED light source as a function of the light emitted from said first light LED source, and wherein the second LED light source copies characteristics of the first LED light source, the photo sensor of the second LED light source being utilized to detect an intensity of the light emitted from the first LED light source to regulate the emitted intensity of the second LED light source to a corresponding level.

2. The LED system according to claim 1, wherein the control unit of the second LED light source includes means for demodulating a modulated light signal detected by the photo sensor.

3. The LED system of claim 1, wherein the LED system is employed for illumination and data transmission.

4. The LED system of claim 1, wherein the control unit of the first LED light source is designed to transmit data wirelessly by modulating the light emitted by a LED.

5. The LED system according to claim 4, wherein the data is transmitted using an analog modulation.

6. The LED system according to claim 4, wherein the data is transmitted using a frequency or amplitude modulation.

7. The LED system according claim 4, wherein the data is transmitted using a pulse modulation method.

8. The LED system according to claim 1, wherein the photo sensor is designed to detect the light signal emitted by the LED of the first LED light source and the control unit is designed to demodulate the light signal detected by the photo sensor so as to obtain the data transmitted wirelessly by said first LED light source.

9. The LED system of claim 1, wherein the system comprises a lighting system comprising a plurality of light units, each light unit including a photo sensor, a light source and a control unit adapted to operate the light source and to modulate the light emitted by the light source so as to transmit data, wherein the light units are arranged according to a ring topology.

10. The LED system of claim 9, wherein each light unit is wirelessly connected to at least a previous light unit and a next light unit, in that said each light unit is able to receive via its photo sensor modulated data from said previous light unit, and to send via its light source modulated data to the next light unit.

11. The LED system of claim 9, wherein the control unit of each light units is designed to demodulate the modulated data or signal received from the previous light unit.

12. The LED system of claim 9, comprising a plurality of light units, each light unit including a photo sensor, a light source and a control unit adapted to operate the light source and to modulate the light emitted by the light source so as to transmit data, wherein the data transmitted by a given light unit propagates over the remaining light units.

13. The LED system according to claim 1, wherein information on the characteristics is directly obtained by analyzing the light received by a photo sensor of the second LED light source, and/or by encoding information by modulation of the first LED light source.

14. A LED system, comprising:

at least a first LED light source and a second LED light source, each light source being provided with a control unit for operating an LED, at least the second LED light source being provided with a photo sensor, wherein the first LED light source is arranged to optically transmit data to the second LED light source, wherein the control unit of said second LED light source sets an operation parameter of said second LED light source as a function of light emitted from said first light LED source, wherein the system comprises a lighting system comprising a plurality of light units, each light unit including a photo sensor, a light source and a control unit adapted to operate the light source and to modulate the light emitted by the light source so as to transmit data, wherein the light units are arranged according to a ring topology, and wherein a light unit, referred to as the master light unit, is adapted to transmit data by modulating the light emitted by its light source, said data being then transmitted automatically among the remaining light units, referred to as slave light units, in that each slave light unit receiving said data automatically forwards said data via its light unit to the next light unit of the ring.

15. The LED system of claim 14, wherein the master light unit stores the data transmitted and waits for the reception of said data from the last slave unit of the ring, which would indicate a successful propagation of the data over the whole ring.

16. The LED system of claim 15, wherein the master light unit retransmits the data if, after a given period of time, it has not received the data from the last slave light unit of the ring.

17. A communication method for a lighting system comprising a plurality of light units arranged according to a ring topology, each light unit including a photo sensor, a light source and a control unit adapted to operate the respective light source and to modulate the light emitted by the light source so as to transmit data, the method comprising:

transmitting, by one of the light units referred to as the master light unit, data wirelessly via its light source, and transmitting said data automatically among the remaining light units of the ring, referred to as slave light units, wherein one of the slave light units copies characteristics of the master light unit, the photo sensor of said one of the slave light unit being utilized to detect an intensity of the light emitted from the master light unit to regulate the emitted intensity of said one of the slave light units to a corresponding level.

* * * * *